United States Patent [19]

Murdock

[11] Patent Number: 4,941,754

[45] Date of Patent: Jul. 17, 1990

[54] INFLATABLE SELF-SUPPORTING BAG

[76] Inventor: Paul Murdock, 168 Elm St., Windsor Locks, Conn. 06096

[21] Appl. No.: 358,121

[22] Filed: May 26, 1989

[51] Int. Cl.[5] ..... B65D 33/00

[52] U.S. Cl. ..... 383/3; 383/33; 383/122; 206/522

[58] Field of Search ..... 383/3, 33, 2, 122, 38; 220/425, 9.1, 9.2, 9.3; 206/543, 541, 522

[56] References Cited

U.S. PATENT DOCUMENTS

| | | | |
|---|---|---|---|
| 750,103 | 1/1904 | Eggers | 383/3 X |
| 2,462,215 | 2/1949 | Norman et al. | 383/3 X |
| 2,580,879 | 1/1952 | Belokin, Jr. | 383/3 |
| 3,428,978 | 2/1969 | Johnson | 383/3 X |
| 3,556,186 | 1/1971 | Besthorne | 383/3 |
| 3,742,994 | 7/1973 | Pensak | 383/3 |
| 3,777,498 | 12/1973 | Andrews et al. | 383/3 X |
| 4,612,781 | 9/1986 | Swerdon | 62/457.1 |
| 4,705,085 | 11/1987 | Brown | 383/3 X |
| 4,858,755 | 8/1989 | Kuivanen | 383/3 X |
| 4,867,576 | 9/1989 | Boyd | 383/3 X |

FOREIGN PATENT DOCUMENTS

| | | | |
|---|---|---|---|
| 2600988 | 1/1988 | France | 383/3 |

*Primary Examiner*—Stephen Marcus
*Assistant Examiner*—Jes F. Pascua
*Attorney, Agent, or Firm*—McCormick, Paulding & Huber

[57] ABSTRACT

An inflatable self-supporting bag formed from a single sheet of flexible air impervious material and having a single ply lower portion defining a bottom wall and a lower portion of a bag side wall and an inflatable upper portion formed by two plies including an inner ply and an outer ply defining an air chamber therebetween. The inner and outer plies are connected together in face-to-face relation along a plurality of spaced apart lines of attachment which divide the air chamber into a plurality of intercommunicating sections which impart a generally cylindrical shape to the upper portion of the bag when it is inflated. A tubular inflating member having an associated removable plug is provided for inflating the upper portion of the bag.

8 Claims, 3 Drawing Sheets

INFLATABLE SELF-SUPPORTING BAG

BACKGROUND OF THE INVENTION

This invention relates in general to disposable containers for trash, garbage, leaves and the like and deals more particularly with an improved inflatable self-supporting trash or yard clean-up bag.

Disposable trash and yard clean-up bags made from lightweight plastic materials have gained widespread acceptance. Such throw-away bags are often used as liners for rigid containers such as wastebaskets, garbage containers and trash cans. However, the cross-sectional area of such a disposable bag is often somewhat greater than the cross-sectional area of the rigid supporting container in which it is received, making it difficult to remove the filled or partially filled bag from the container. The latter condition is frequently encountered with respect to a yard clean-up bag used to dispose of leaves, grass clippings and like materials which tend to be compressed or become compacted as the quantity of material put into the bag increases, resulting in the bag becoming jammed within its associated container.

Heretofore, inflatable self-supporting bags have been provided which do not require a rigid supporting structure to overcome the aforedescribed problem. Typical examples of such inflatable, self-supporting bags are found in U.S. Pat. No. 3,556,186 to Besthorne, issued Jan. 19, 1971, and U.S Pat. No. 3,742,994 to Pensak, issued Oct. 21, 1971 and assigned to Colgate-Palmolive Company.

A typical inflatable, self-supporting bag of the aforedescribed type is of lightweight construction and has a height dimension substantially greater than its major width dimension. When empty, such a self-supporting bag tends to be unstable and prone to tipping, even in a light breeze. Consequently, such a bag is not particularly suitable for outdoor usage. Further, in manufacturing a bag of the aforedescribed type, it is necessary to provide a separate bottom panel for attachment to the lower margin of the bag side walls to allow the inflatable side walls at the lower end of the bag to expand to the full cross-sectional area of the bag to provide an adequate support base for the bag, which adds substantially to the cost of producing such a bag.

Accordingly, it is the general aim of the present invention to provide an improved inflatable self-supporting bag which overcomes the aforedescribed problems and which may be produced at lower cost using a smaller quantity of material than required to make a prior art bag of comparable size.

SUMMARY OF THE INVENTION

In accordance with the present invention an improved inflatable self-supporting bag has a lower portion formed from a single ply of sheet material which defines a bottom wall and the lower portion of the bag side wall. An upper portion of the bag contiguous with the lower portion is formed by two plies of air impervious sheet material and defines the remainder of the bag side wall and a mouth at the upper end of the bag. The two plies cooperate to define an air chamber therebetween. A means is provided for introducing air under pressure into the chamber to impart structural integrity to the upper part of the bag. A means is also provided for releasably retaining air under pressure in the upper portion of the bag to maintain the upper portion in inflated condition.

DETAILED DESCRIPTION OF PREFERRED EMBODIMENT

Figure 2:
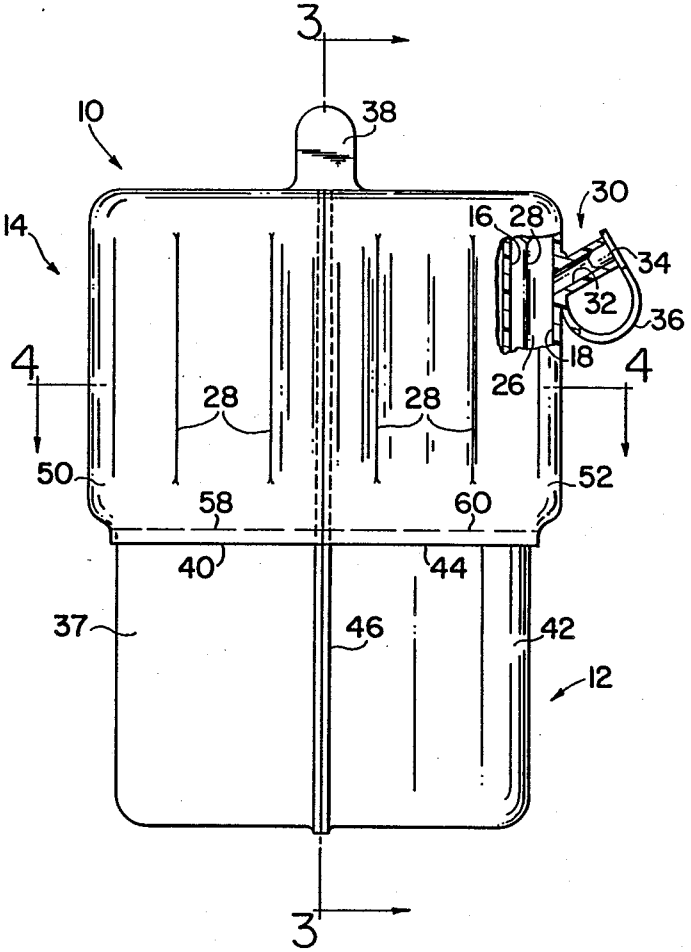
FIG. 2 is a somewhat enlarged side elevational view of the bag of FIG. 1 shown in an inflated, filled condition.

Turning now to the drawings, an inflatable self-supporting bag embodying the present invention is indicated generally by the reference numeral 10. The illustrated bag 10 is particularly suitable for use as a yard clean-up bag for disposing of leaves, grass clippings and the like and is preferably made from durable, lightweight, flexible polymeric, air impervious sheet material. As oriented in the drawings, the bag has a lower portion, indicated generally at 12, formed from a single ply of sheet material and an inflatable upper portion, designated generally by the numeral 14, contiguous to the lower portion and formed by two plies which include an inner ply 16 and an outer ply 18. The lower portion 12 defines a bottom wall 20 and a portion of a side wall indicated at 22. The remainder of the side wall 22 is defined by the upper portion 14, which also defines a mouth opening 24 at the upper end of the bag.

Figure 4:
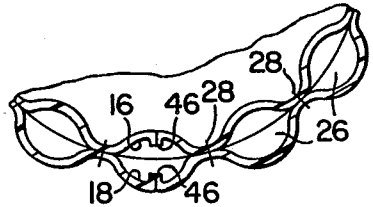
FIG. 4 is a fragmentary sectional view taken along the line 4—4 of FIG. 3.
Figure 3:
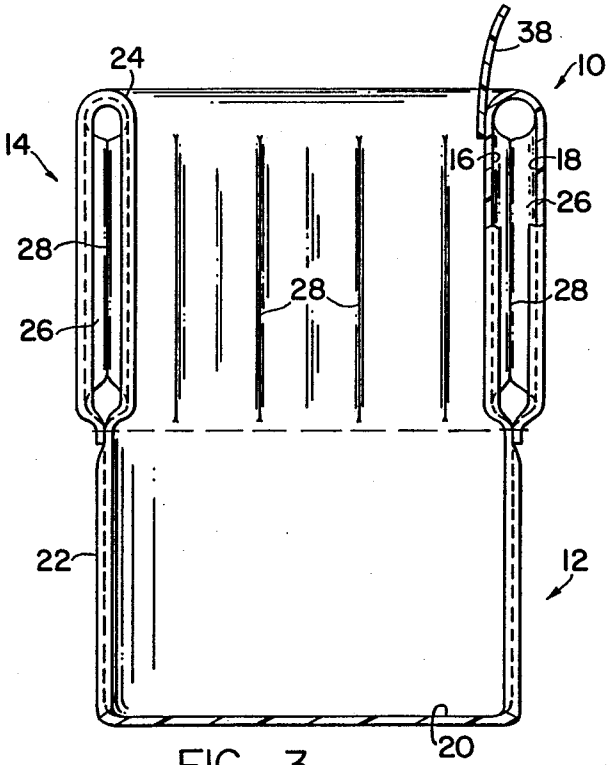
FIG. 3 is a sectional view taken along the line 3—3 of FIG. 2, the material in the bag not being shown.

The inner ply 16 and the outer ply 18 cooperate to form an air chamber 26 therebetween, best shown in FIGS. 3 and 4. A series of spaced apart generally vertically extending lines of attachment 28, 28 connect the inner ply 16 and the outer ply 18 in face-to-face relation to each other and terminate below the upper end of the upper portion 14 and above the lower end of the upper portion 14 and divide the air chamber 26 into a plurality of intercommunicating, vertically extending sections. The latter lines of attachment, which are preferably formed by heat sealing the plies 16 and 18 in face-to-face engagement with each other, cause the upper portion 14 to assume a generally cylindrical configuration when inflated.

A tubular inflating member indicated generally at 30 and connected to the upper portion 14 has a bore 32 which extends through one of the two plies 14 and 16 and communicates with the air chamber 26 for inflating the upper portion of the bag 10. As shown, the inflating member 30 is connected to the outer ply 18 and has a plug 34 integrally connected to it by a flexible strap 36. The bag provides a closure for sealing the bore 32 to retain the upper portion 14 in inflated condition.

Figure 1:
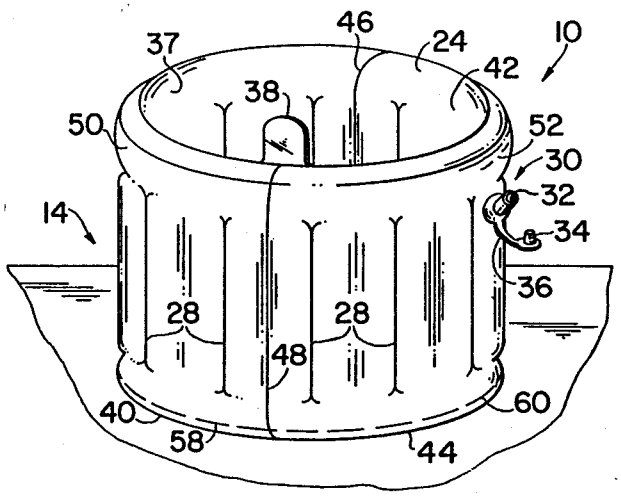
FIG. 1 is a perspective view of an inflatable self-supporting bag embodying the present invention shown in an inflated condition and resting on a supporting surface.

The illustrated bag 10 further includes a flexible step tab 38, for a purpose which will be hereinafter explained. The step tab is attached to the upper portion 14 near the mouth opening 24 and extends for some distance outwardly beyond the mouth opening, as shown in FIGS. 1–3.

Figure 5:
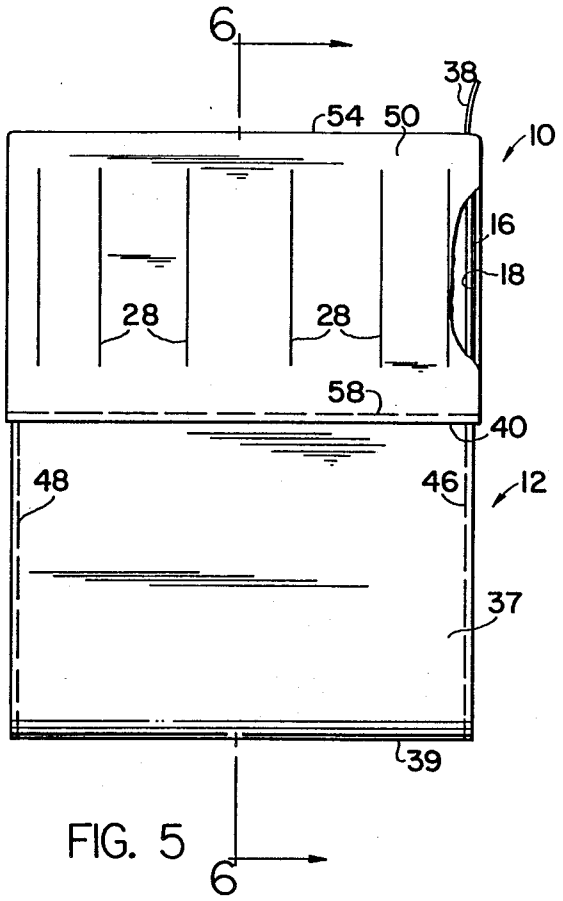
FIG. 5 is a somewhat reduced side elevational view showing the bag of FIG. 1 in its collapsed condition, before being inflated.
Figure 6:
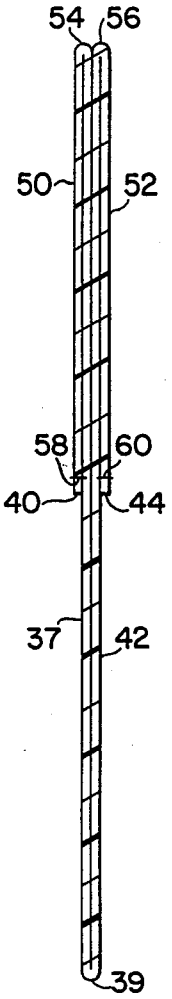
FIG. 6 is a sectional view taken along the line 6—6 of FIG. 5.

In accordance with the presently preferred construction method, the bag 10 is made by folding an elongated generally rectangular strip of sheet material onto itself along transversely extending fold lines to define a plurality of integrally connected overlying rectangular panels and adhering or otherwise connecting the panels together along longitudinally and transversely extending lines of attachment, as further illustrated with reference to FIGS. 5–7.

Figure 7:
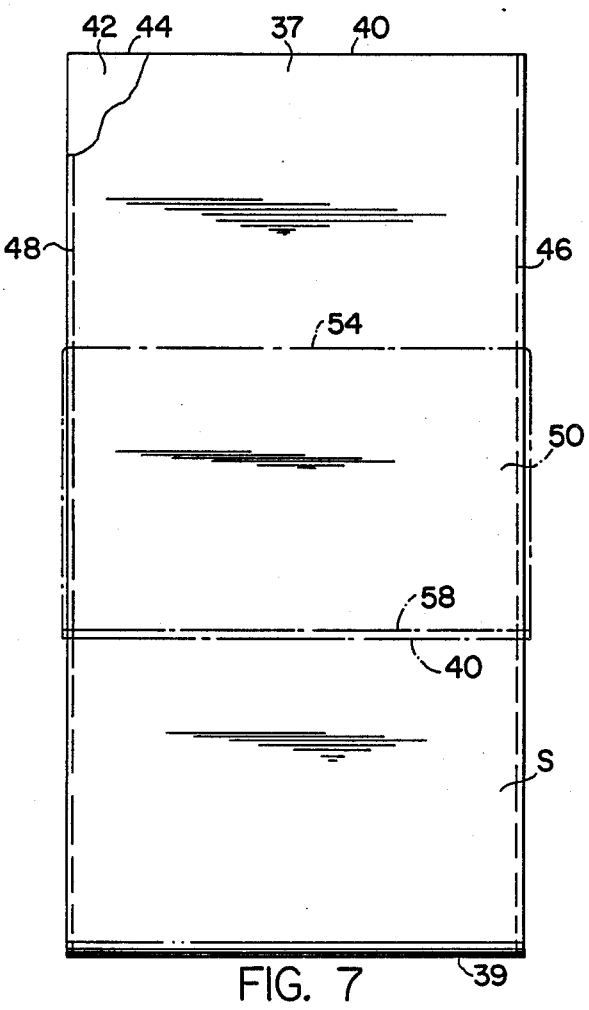
FIG. 7 is a side elevational view of a partially completed inflatable self-supporting bag.

In FIG. 7, the strip, indicated by the letter S, is shown in full lines after having been folded in half along a longitudinally extending bottom fold line 39 to define a first panel 37 which has a free edge 40 and a second panel 42 which has a free edge 44. The associated side marginal edge portions of the panels 37 and 42 are next connected together in face-to-face relation along opposite side marginal edges thereof by vertically extending lines of attachment 46 and 48, which are preferably formed by heat sealing, to form a flat bag-like structure. Thereafter, the upper part of the latter structure, shown in full lines in FIG. 7, is turned downwardly and outwardly over the lower part of the structure and drawn downwardly to the broken line position of FIG. 7 thereby forming two additional generally rectangular panels 50 and 52 which overlie the remaining upper portions of the panels 37 and 42, respectively. The upper ends of the panels 50 and 52 are connected to the upper ends of the panels 37 and 42, respectively, by transversely extending fold lines 54 and 56, as best shown in FIG. 6. Thereafter, the lower edge portions 40 and 44 are connected to the panels 37 and 42, respectively, along lines of attachment 58 and 60. The vertically extending lines of attachment 28,28 are thereafter formed to adhere or heat seal the panel 50 to associated portions of the underlying panel 37 and the panel 52 to associated portions of the underlying panel 42. The inflating member 30 and its associated plug 34 and connecting strip 36 and the step tab 38 are thereafter attached to the upper portion 14 to complete the bag 10. In its collapsed position, as it appears in FIG. 5, the bag 10 presents a substantially flat package which may be folded or rolled for positioning in an associated dispensing package.

Preparatory to use, the bag 10 is inflated by blowing into the inflating tube 30. As previously noted, the lines of attachment 28,28 cause the inflated upper portion to assume a substantially cylindrical self-supporting configuration. In addition to controlling the shape of the upper portion 14, the lines of attachment 28,28, which divide the air chamber 26 into a plurality of intercommunicating sections, reduce the volume of the chamber 26 defined by the plies 16 and 18, so that the upper part 14 does not require a large volume of air for inflation.

In its inflated condition, as it appears in FIG. 1 resting on a supporting surface, the bag 10 presents a relatively low profile to resist tipping, the lower portion 12 being in a collapsed or limp condition and resting on the supporting surface. This low profile facilitates initial loading of material into the bag 10 when the bag is positioned on the ground or on another supporting surface, as it appears in FIG. 1. However, to facilitate loading the bag may also be rested on its side so that material may be raked or swept into it. The step tab 38 provides a convenient means for stabilizing the bag when it is loaded in this manner. More specifically, the bag may be stabilized by stepping on the tab 38 during initial loading.

When the upper portion 14 has been substantially filled, the bag is lifted causing the material in the bag to shift to the lower portion 12 thereby imparting structural integrity to the lower portion. When the bag has been filled, the upper portion 14 may be deflated by simply removing the plug 34 from its sealing position within the tubular inflating member 30 to allow the mouth of the bag to be closed and sealed using a conventional bag tie or the like (not shown).

It is only necessary that the upper part 14 maintain its structural integrity until the bag 10 has been partially filled. Consequently, should one of the plies 16 or 18 be punctured while the bag 10 is being loaded, it will not lose its utility.

I claim:

1. A collapsed inflatable self-supporting bag comprising a substantially flat generally rectangular structure defined by a plurality of generally rectangular sheet material panels, each of said panels being connected in face-to-face relation to another of said panels, said structure having a lower portion formed from a single ply of sheet material and including two substantially rectangular panels connected together in face-to-face relation along bottom and side marginal edge portions thereof defining a bag bottom and a portion of a bag sidewall, and an inflatable upper portion contiguous to said lower portion and formed by a plurality of generally rectangular air impervious sheet material panels defining two plies including an inner ply and an outer ply, said upper portion defining the remaining portion of said sidewall and a mouth opening at the upper end thereof, said inner ply and said outer ply cooperating to define an air chamber therebetween, connecting means for attaching said inner ply and said outer ply in face-to-face relation to each other along generally parallel lines of attachment to divide said chamber into a plurality of intercommunicating sections inflating means for introducing air into said chamber to inflate said upper portion, said upper portion in its inflated condition having a generally cylindrical configuration being defined by a plurality of intercommunicating elongate tubular portions immediately adjacent to each other and extending in parallel relation to the central axis of said upper portion, said lower portion depending from said upper portion, and closure means for releasably retaining said upper portion in inflated condition.

2. An inflatable self-supporting bag as set forth in claim 1 wherein said connecting means comprises heat sealing means.

3. An inflatable self-supporting bag as set forth in claim 1 wherein said lower portion defines at least one-half of said side wall.

4. An inflatable self-supporting bag as set forth in claim 1 including a step tab connected to an associated portion of said upper portion near said mouth and extending for some distance outwardly beyond said mouth.

5. An inflatable self-supporting bag as set forth in claim 1 wherein said bag comprises a single sheet of flexible air impervious material.

6. An inflatable self-supporting bag as set forth in claim 1 wherein said inflating means comprises a tubular inflating member connected to said upper portion and having a bore therethrough communicating with said air chamber.

7. An inflatable self-supporting bag as set forth in claim 6 wherein said closure means comprises a plug integrally connected to said bag for sealing said bore.

8. A collapsed inflatable self-supporting bag comprising a substantially flat generally rectangular structure formed from an elongated longitudinally extending generally rectangular strip of flexible air impervious sheet material and having a plurality of generally rectangular panels connected together along transversely extending fold lines and in face-to-face relation including substantially identical first and second panels connected together along a transversely extending bottom fold line and connected together in face-to-face relation along the opposite side marginal edges thereof by first and second vertically extending lines of attachment, a third panel connected to the upper edge of said first panel along a transversely extending first upper fold line and overlying an associated upper outer surface portion of said first panel, said third panel being further connected along its lower marginal edge in face-to-face relation to said first panel along a transversely extending first lower line of attachment spaced upwardly from said bottom fold line, a fourth panel substantially identical to said third panel and connected to the upper edge of said second panel along a transversely extending second upper fold line and an associated upper outer surface portion of said second panel, said third panel being further connected along its lower marginal edge in face-to-face relation to said second panel along a transversely extending second lower line of attachment spaced upwardly from said bottom fold line, said third and fourth panels being connected together in face-to-face relation to each other along the opposite side marginal edges thereof by third and fourth vertically extending lines of attachment, said third and fourth panels cooperating with the upper portions of said first and second panels to define an air chamber therebetween, a plurality of horizontally spaced apart and vertically extending fifth lines of attachment connecting associated portions of said third panel in face-to-face relation with said first panel and said fourth panel in face-to-face relation with said second panel and dividing said air chamber into a plurality of intercommunicating sections, means for introducing air under pressure into said air chamber, and means for releasably retaining air under pressure in said air chamber.

* * * * *